US007848844B2

(12) United States Patent
Nemoto

(10) Patent No.: US 7,848,844 B2
(45) Date of Patent: Dec. 7, 2010

(54) SUBSTRATE GRINDING METHOD AND DEVICE

(75) Inventor: Seiji Nemoto, Ota-Ku (JP)

(73) Assignee: Disco Corporation, Tokyo (JP)

( * ) Notice: Subject to any disclaimer, the term of this patent is extended or adjusted under 35 U.S.C. 154(b) by 487 days.

(21) Appl. No.: 12/099,424

(22) Filed: Apr. 8, 2008

(65) Prior Publication Data

US 2008/0268752 A1 Oct. 30, 2008

(30) Foreign Application Priority Data

Apr. 27, 2007 (JP) ..... 2007-118623

(51) Int. Cl.
*G06F 19/00* (2006.01)
*G05B 11/01* (2006.01)
*G05D 3/00* (2006.01)
*G01C 25/00* (2006.01)

(52) U.S. Cl. ..... 700/164; 700/72; 700/170; 700/174; 700/175; 700/193; 700/303; 702/97; 702/170; 451/11; 438/5

(58) Field of Classification Search ..... 700/72, 700/77, 108, 109, 121, 164, 170, 172, 173–175, 700/193, 303; 702/97, 170–172; 438/5, 438/7, 14, 16; 451/1, 5, 6, 11–13
See application file for complete search history.

(56) References Cited

U.S. PATENT DOCUMENTS 4,662,120 A * 5/1987 Imai et al. ..... 451/239
5,402,354 A * 3/1995 Okino et al. ..... 700/174

FOREIGN PATENT DOCUMENTS

JP A 2003-300155 10/2003

* cited by examiner

*Primary Examiner*—Sean P Shechtman
(74) *Attorney, Agent, or Firm*—Greer, Burns & Crain, Ltd.

(57) ABSTRACT

A grinding method wherein the correlation between the amount of inertial grinding occurring in performing spark-out by a grinding unit and the maximum load current in a motor of the grinding unit is grasped, and a correction value for the amount of inertial grinding corresponding to the maximum load current is preliminarily obtained. When the wafer thickness measured by a thickness measuring gauge has reached the sum of a desired value and the correction value (=the amount of inertial grinding) corresponding to the maximum load current, the spark-out is started. Accordingly, the wafer thickness becomes the desired value after the inertial grinding in performing the spark-out.

2 Claims, 5 Drawing Sheets

SUBSTRATE GRINDING METHOD AND DEVICE

BACKGROUND OF THE INVENTION

1. Field of the Invention

The present invention relates to a substrate grinding method and device for grinding a subject surface of a substrate by pressing a grinding tool such as a grinding wheel on the subject surface as rotating the grinding tool.

2. Description of the Related Art

A reduction in size and weight of a semiconductor device has increasingly become remarkable in recent years. To realize a reduction in thickness of the device, the back side of a device substrate such as a semiconductor wafer having a front side formed with many devices is ground to obtain a desired thickness prior to separating the device substrate into the individual devices. In general, the back side of the substrate is ground by using a grinding device including a vacuum chuck type chuck table for holding the substrate by using suction vacuum and a grinding tool such as a grinding wheel opposed to the chuck table, wherein the chuck table holding the wafer is rotated and the grinding tool is rotated and fed to be pressed on the subject surface of the substrate. When the substrate thickness has reached a desired value in grinding the substrate by using such a grinding device, so-called "spark-out" is performed to stop the feed of the grinding tool and continue the rotation of the grinding tool at the feed stop position for a predetermined period of time. After the elapse of the predetermined period of time for the spark-out, the grinding tool is retracted from the substrate.

The spark-out is required for the purposes of flattening the ground surface of the substrate by at least once rotating the substrate and removing a grinding strain from the substrate. During grinding of the substrate, the grinding tool may be contracted by application of a working load or physical distortion may be produced between the chuck table and the grinding tool, causing the inclusion of residual stress in the grinding device. Accordingly, in performing the spark-out, the residual stress is relieved, so that the grinding tool is engaged in the ground surface of the substrate. As a result, the ground surface of the substrate is excessively ground and the substrate thickness therefore becomes smaller than the desired value. To cope with this problem, the feed stop position of the grinding tool, or the spark-out start position is set slightly higher than the position corresponding to the desired thickness in expectation of the amount of inertial grinding occurring in performing the spark-out. Thus, the amount of inertial grinding is provided as a correction value.

However, even though the grinding conditions are fixed, the amount of inertial grinding caused by the residual stress changes according to various factors such as a minute change in condition of the grinding tool that may be worn and a difference in machinability due to variations in thermal history of the substrate. On the other hand, the correction value corresponding to the amount of inertial grinding is a fixed value. Accordingly, there is a case that the correction value does not become a proper correction value. As a result, the substrate thickness after finishing of the grinding, i.e., after the spark-out in grinding numerous substrates may vary. That is, there are variations in substrate thickness after the spark-out in grinding numerous substrates.

SUMMARY OF THE INVENTION

It is therefore an object of the present invention to provide a substrate grinding method and device which can uniformly make the substrate thickness with high accuracy without variations in thickness of substrates even when the amount of inertial grinding occurring in performing the spark-out varies in grinding of each substrate.

In accordance with an aspect of the present invention, there is provided a grinding method for grinding a subject surface of a substrate by using a grinding device comprising: holding means having a holding surface for holding said substrate in the condition where said subject surface of said substrate is exposed; grinding means opposed to said holding surface of said holding means and having a rotation axis extending substantially parallel to a rotation axis of said holding means; a motor for rotationally driving said grinding means; motor load current monitoring means for monitoring a load current in said motor; feeding means for relatively moving said holding means and said grinding means in a direction of extension of said rotation axis of said grinding means toward and away from each other and for making said grinding means grind said subject surface of said substrate to reduce the thickness of said substrate by moving said grinding means toward said holding means; substrate thickness measuring means for measuring the thickness of said substrate held by said holding means during grinding of said substrate by said grinding means; and feed control means for performing spark-out such that when the thickness of said substrate measured by said substrate thickness measuring means reaches a desired value, the feed of said grinding means by said feeding means is stopped and the rotation of said grinding means by said motor is continued for a predetermined period of time at the feed stop position of said grinding means; said grinding method comprising steps of: preliminarily grasping the correlation between the amount of inertial grinding occurring in performing said spark-out by said grinding means and the load current in said motor monitored by said motor load current monitoring means; and said feed control means starting said spark-out when the thickness of said substrate measured by said substrate thickness measuring means has reached the sum of said desired value and the amount of inertial grinding corresponding to the load current in said motor.

According to the grinding method of the present invention, the amount of inertial grinding by the grinding means as occurring in performing the spark-out is preliminarily grasped by using the load current in the motor as an index. In the case that the residual stress causing the inertial grinding in performing the spark-out is produced during grinding of the substrate, the amount of inertial grinding is proportional to the residual stress. A grinding force increases with an increase in residual stress, proportionally causing an increase in load current in the motor. Conversely, the grinding force decreases with a decrease in residual stress, proportionally causing a decrease in load current in the motor. Based on this principle, the load current in the motor during the grinding operation is monitored by the motor load current monitoring means, and the amount of inertial grinding as expected in performing the spark-out is preliminarily grasped from the load current in the motor as monitored.

When the substrate thickness measured by the substrate thickness measuring means has reached the sum of the desired value and the amount of inertial grinding corresponding to the load current in the motor, the spark-out is started, i.e., the feed of the grinding means is stopped and the rotation of the grinding means is continued for a predetermined time period. After the elapse of the predetermined time period for the spark-out, the grinding means is retracted from the substrate to finish the whole grinding operation. In performing the spark-out, the amount of inertial grinding corresponding to the load current in the motor is caused to slightly grind the substrate. However, the feed of the grinding means is stopped in expectation of the amount of inertial grinding according to the present invention, so that the substrate thickness finally becomes the desired value. According to the present invention, the start position of the spark-out is corrected to a position in expectation of the amount of inertial grinding corresponding to the load current in the motor, so that the spark-out start position can be properly corrected every time the grinding operation for the substrate is performed. As a result, the final substrate thickness after finishing of the whole grinding operation can be always reduced to a desired value, and variations in substrate thickness in grinding numerous substrates can also be suppressed. In the present invention, it is preferable that the amount of inertial grinding corresponding to the load current in the motor to be added to the desired value of the substrate thickness is to be the most effective amount sufficiently reflecting the residual stress. From this point of view, the load current in the motor from which the amount of inertial grinding is derived is preferably a maximum load current immediately before performing the spark-out.

In accordance with another aspect of the present invention, there is provided a grinding device including holding means having a holding surface for holding a substrate in the condition where a subject surface of the substrate is exposed; grinding means opposed to the holding surface of the holding means and having a rotation axis extending substantially parallel to a rotation axis of the holding means; a motor for rotationally driving the grinding means; motor load current monitoring means for monitoring a load current in the motor; feeding means for relatively moving the holding means and the grinding means in a direction of extension of the rotation axis of the grinding means toward and away from each other and for making the grinding means grind the subject surface of the substrate to reduce the thickness of the substrate by moving the grinding means toward the holding means; substrate thickness measuring means for measuring the thickness of the substrate held by the holding means during grinding of the substrate by the grinding means; feed control means for performing spark-out such that when the thickness of the substrate measured by the substrate thickness measuring means reaches a desired value, the feed of the grinding means by the feeding means is stopped and the rotation of the grinding means by the motor is continued for a predetermined period of time at the feed stop position of the grinding means; and storing means for storing the correlation between the amount of inertial grinding occurring in performing the spark-out by the grinding means and the load current in the motor monitored by the motor load current monitoring means; wherein when the thickness of the substrate measured by the substrate thickness measuring means has reached the sum of the desired value and the amount of inertial grinding corresponding to the load current in the motor, the feed control means starts the spark-out.

According to the grinding device of the present invention, the spark-out start position is properly corrected to a position in expectation of the amount of inertial grinding corresponding to the load current in the motor, so that the substrate thickness can be always reduced to a desired value, and variations in substrate thickness can be suppressed.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

A preferred embodiment of the present invention will now be described with reference to the drawings.

[1] Semiconductor Wafer (Substrate)

Figure 1A:
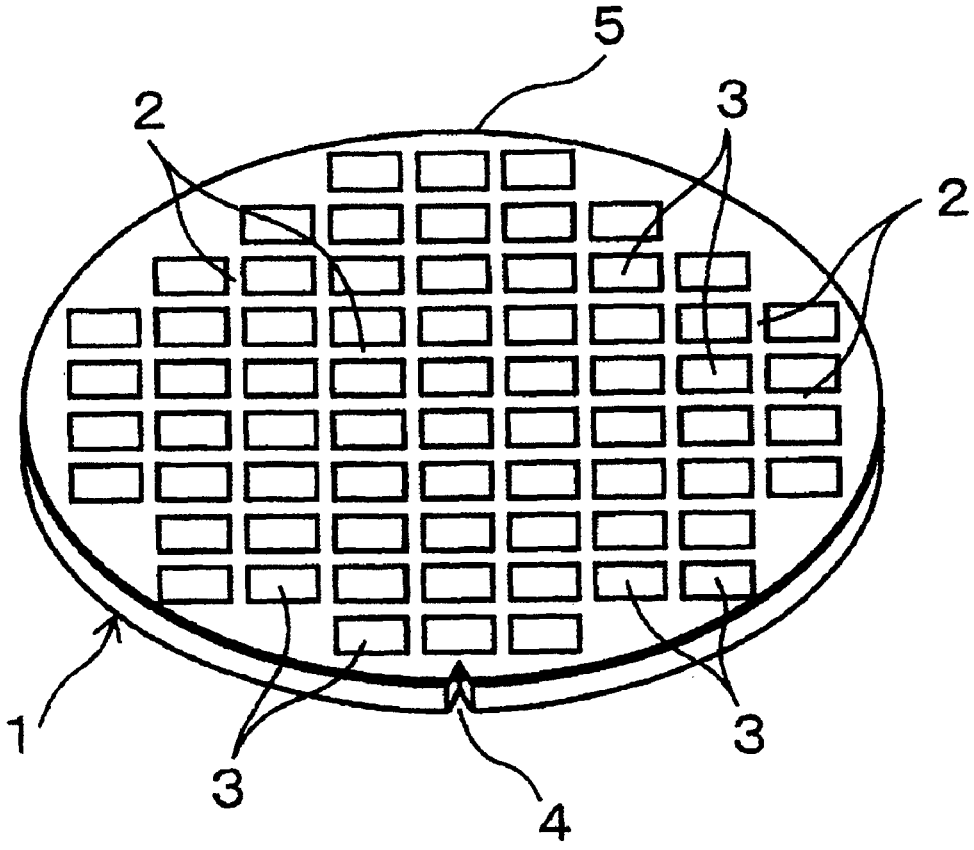
FIG. 1A is a perspective view of a semiconductor wafer whose back side is to be ground by a grinding device according to a preferred embodiment of the present invention.

Reference numeral 1 shown in FIG. 1A denotes a disk-shaped semiconductor wafer (which will be hereinafter referred to simply as wafer) whose back side is to be ground by a grinding device shown in FIG. 2, thereby obtaining a reduced thickness of the wafer 1. The wafer 1 is a silicon wafer or the like, for example, and the thickness of the wafer 1 before ground is about 700 μm, for example. A plurality of crossing separation lines 2 are formed on the front side of the wafer 1 to thereby partition a plurality of rectangular semiconductor chips 3. An electronic circuit such as IC or LSI is formed on the front side of each semiconductor chip 3. A V-shaped notch 4 for indicating the crystal orientation of a semiconductor is formed on the outer circumference of the wafer 1 at a predetermined position. The wafer 1 is finally cut to be separated along the separation lines 2 to obtain the individual semiconductor chips 3.

Figure 1B:
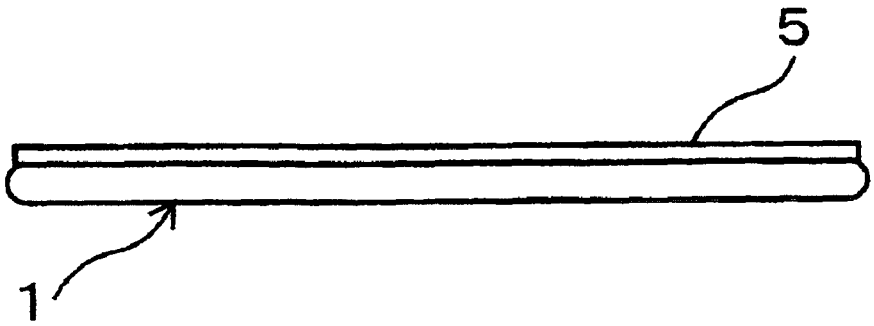
FIG. 1B is a side view of the wafer shown in FIG. 1A.

As shown in FIG. 1B, a protective tape 5 for protecting the electronic circuits of the semiconductor chips 3 is attached to the front side of the wafer 1 prior to grinding the back side of the wafer 1. The protective tape 5 is composed of a base sheet formed of a soft resin such as polyolefin and an adhesive layer coated on one side of the base sheet. For example, the base sheet has a thickness of about 70 to 200 μm, and the adhesive layer has a thickness of about 5 to 20 μm. The adhesive layer of the protective tape 5 is attached to the front side of the wafer 1. The back side of the wafer 1 is ground by using a grinding device 10 shown in FIG. 2 to thereby reduce the thickness of the wafer 1 to about 50 to 100 μm, for example.

[2] Basic Configuration and Operation of the Grinding Device

Figure 2:
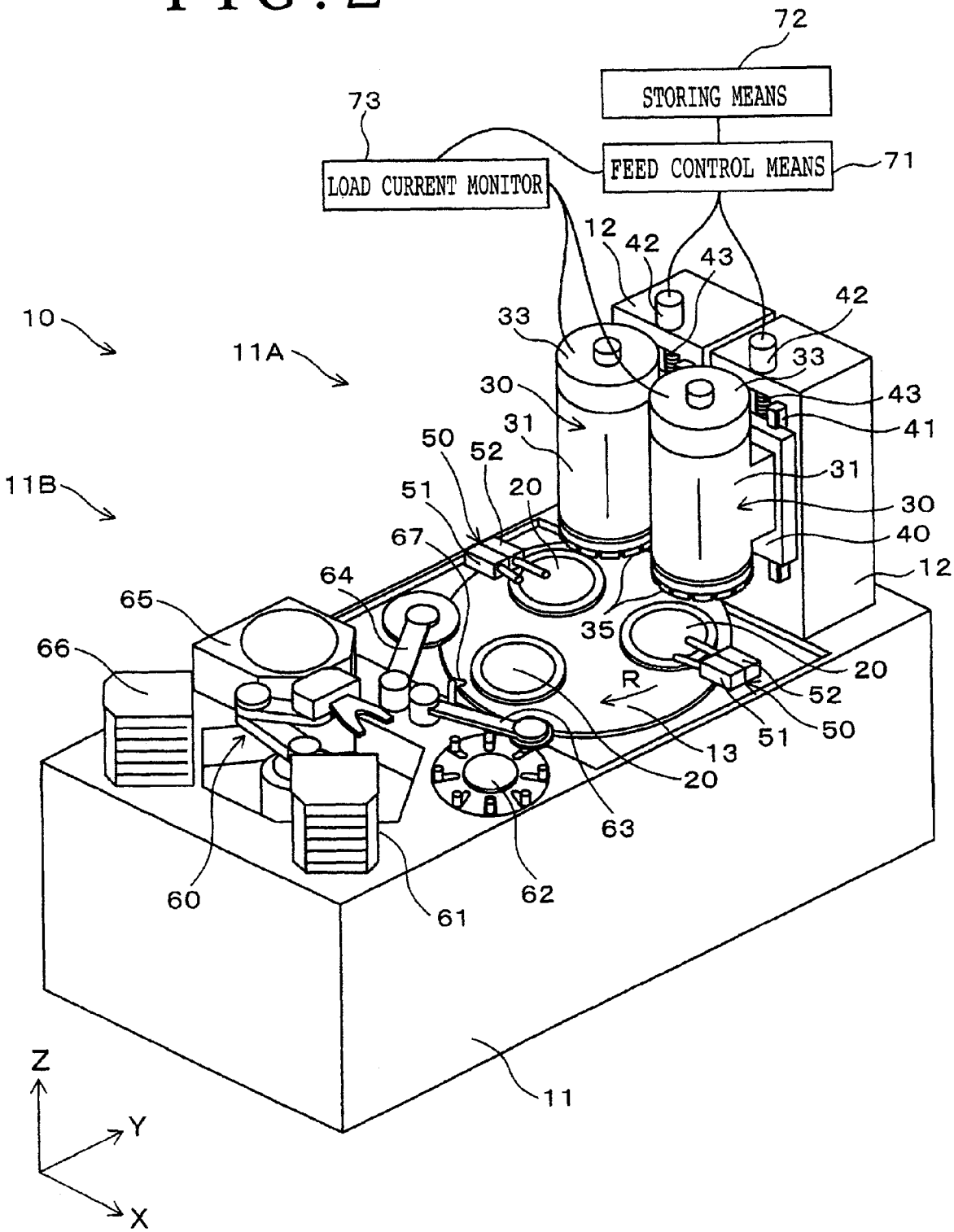
FIG. 2 is a perspective view of the grinding device according to the preferred embodiment.

As shown in FIG. 2, the grinding device 10 includes a rectangular parallelepiped base 11 having a horizontal upper surface. In FIG. 2, the longitudinal direction, lateral direction, and vertical direction of the base 11 are shown by a Y direction, X direction, and Z direction, respectively. A pair of columns 12 juxtaposed in the X direction stand on the upper surface of the base 11 at its one end portion in the Y direction (at the rear portion of the upper surface of the base 11). The rear portion of the upper surface of the base 11 at which the columns 12 are located is formed as a grinding area 11A where the wafer 1 is ground, and the front portion of the upper surface of the base 11 is formed as a mount/demount area 11B where the wafer 1 before ground is supplied to the grinding area 11A and the wafer 1 after ground is recovered.

In the grinding area 11A, a disk-shaped turn table 13 is rotatably provided. The turn table 13 has a rotation axis extending parallel to the Z direction, and has a horizontal upper surface. The turn table 13 is rotated in the direction shown by an arrow R in FIG. 2 by a rotational driving mechanism (not shown). A plurality of (three in this preferred embodiment) disk-shaped chuck tables (holding means) 20 are rotatably arranged on the turn table 13 so as to be equally spaced in the circumferential direction of the turn table 13. Each chuck table 20 has a rotation axis extending parallel to the Z direction, and is rotated in one direction by a rotational driving mechanism (not shown). When the turn table 13 is rotated, the chuck tables 20 on the turn table 13 are rotated about the rotation axis of the turn table 13. The wafer 1 is held on the substantially horizontal upper surface of each chuck table 20 in a concentrical manner.

Figure 3B:
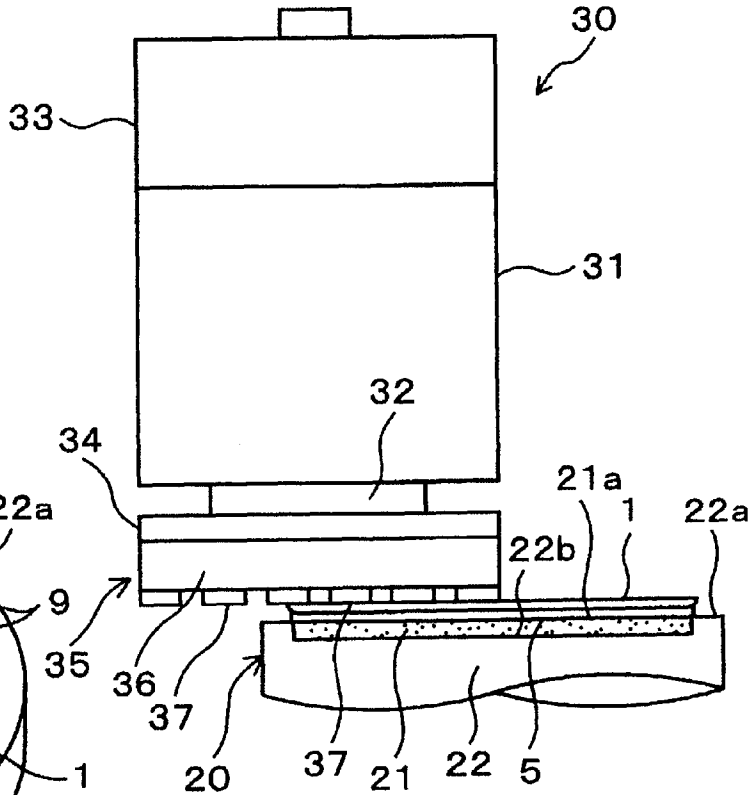
FIG. 3B is a side view of the grinding unit shown in FIG. 3A.
Figure 3A:
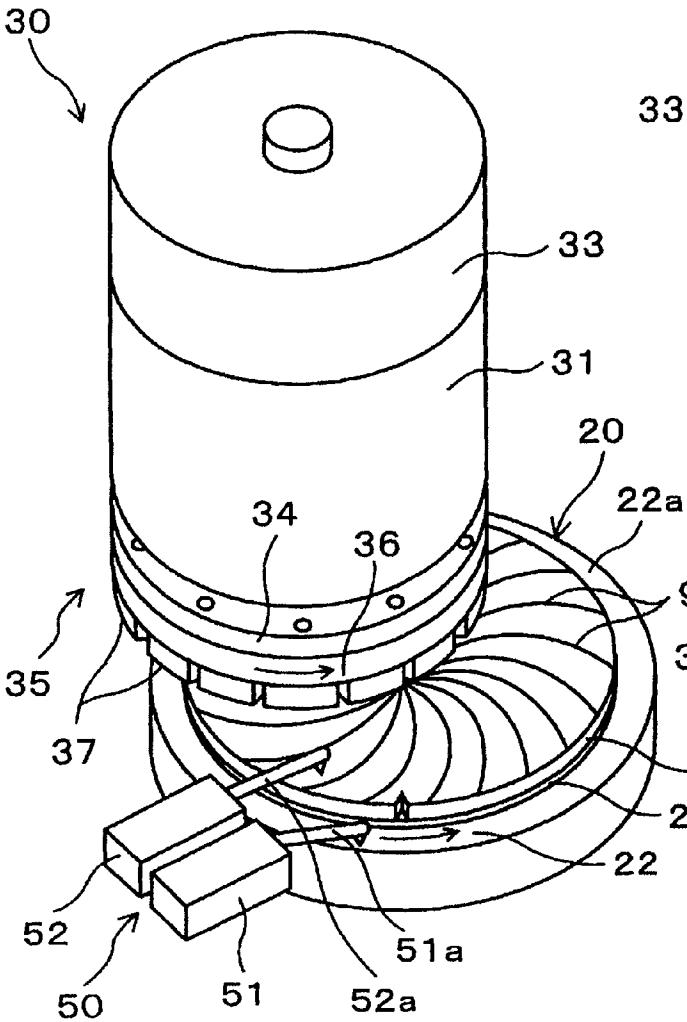
FIG. 3A is a perspective view showing a grinding unit included in the grinding device shown in FIG. 2.

Each chuck table 20 is of a generally known vacuum chuck type such that the wafer 1 placed on the upper surface of each chuck table 20 is held by using suction vacuum. As shown in FIGS. 3A and 3B, each chuck table 20 includes a disk-shaped body 22. The upper surface of the body 22 is formed with a shallow recess 22*b*. The shallow recess 22*b* is filled with a porous suction area 21 having an upper surface (holding surface) 21*a*. The wafer 1 is held on the upper surface 21*a* of the suction area 21.

As shown in FIG. 2, two grinding units (grinding means) 30 are provided directly above two of the chuck tables 20 in the condition where these two chuck tables 20 are arranged in the X direction close to the two columns 12. By the rotation of the turn table 13, each chuck table 20 is adapted to have two grinding positions directly below the two grinding units 30 and a mount/demount position nearest to the mount/demount area 11B. Thus, the two grinding positions respectively correspond to the two grinding units 30. One of the two grinding positions on the upstream side in the direction of movement of each chuck table 20 (shown by the arrow R) by the rotation of the turn table 13 (on the left side as viewed in FIG. 2) is referred to as a primary grinding position, and the other grinding position on the downstream side is referred to as a secondary grinding position. Coarse grinding is performed at the primary grinding position, and finish grinding is performed at the secondary grinding position.

Each grinding unit 30 is fixed to a slider 40 vertically movably mounted on the corresponding column 12. The slider 40 is slidably engaged with a pair of guide rails 41 extending in the Z direction. The slider 40 is movable in the Z direction by a ball screw type feeding mechanism 43 driven by a servo motor 42. Accordingly, each grinding unit 30 is moved in the Z direction by the feeding mechanism 43. By a feed operation such that each grinding unit 30 is lowered to come into contact with the corresponding chuck table 20, the exposed surface of the wafer 1 held on the chuck table 20 is ground by this grinding unit 30. The operation of the servo motor 42 for rotating the feeding mechanism 43 is controlled by feed control means 71.

As shown in FIGS. 3A and 3B, each grinding unit 30 includes a cylindrical spindle housing 31 having an axis extending in the Z direction, a spindle shaft 32 coaxially and rotatably supported in the spindle housing 31, a motor 33 coaxially fixed to the upper end of the spindle housing 31 for rotationally driving the spindle shaft 32, and a disk-shaped flange 34 coaxially fixed to the lower end of the spindle shaft 32. A grinding wheel 35 is detachably mounted on the lower surface of the flange 34 by using any mounting means such as screws.

The grinding wheel 35 is composed of an annular frame 36 formed of aluminum or the like and a plurality of abrasive members 37 fixed to the lower surface of the annular frame 36 so as to be spaced in the circumferential direction of the annular frame 36. The surface to be ground (the subject surface of the substrate) by the abrasive members 37 is perpendicular to the rotation axis of the grinding unit 30, i.e., the axial direction of the spindle shaft 32. For example, each abrasive member 37 is produced by mixing diamond abrasive grains in a vitreous bond, forming the resultant mixture, and sintering the formed mixture. Each abrasive member 37 of the grinding unit 30 for primary grinding contains relatively coarse abrasive grains having a grain size of about #320 to #400, whereas each abrasive member 37 of the grinding unit 30 for secondary grinding contains relatively fine abrasive grains having a grain size of about #2000 to #8000. Although not shown, the flange 34 and the grinding wheel 35 of each grinding unit 30 are provided with a grinding water supplying mechanism for supplying a grinding water for cooling and lubrication of the subject surface or for removal of dust. Further, a water supply line is connected to the grinding water supplying mechanism.

As shown in FIG. 2, two thickness measuring gauges (substrate thickness measuring means) 50 are provided on the base 11 near the two chuck tables 20 at the primary grinding position and the secondary grinding position, respectively. Each thickness measuring gauge 50 is composed of a reference height gauge 51 and a wafer height gauge 52. As shown in FIG. 3A, the reference height gauge 51 has a swingable reference probe 51*a* whose front end comes into contact with the upper surface 22*a* of the body 22 of the chuck table 20 which surface is not covered with the wafer 1, thereby detecting the height of the upper surface 22*a* of the body 22. The upper surface 22*a* of the body 22 is flush with the upper surface 21*a* of the suction area 21 for actually holding the wafer 1. On the other hand, the wafer height gauge 52 has a swingable fluctuating probe 52*a* whose front end comes into contact with the upper surface of the wafer 1 (the subject surface to be ground) held on the chuck table 20, thereby detecting the height of the upper surface of the wafer 1.

According to each thickness measuring gauge 50, the thickness of the wafer 1 is measured according to the value obtained by subtracting a measured value by the reference height gauge 51 from a measured value by the wafer height gauge 52. In this preferred embodiment, the protective tape 5 is attached to the front side of the wafer 1, so that the thickness of the protective tape 5 is added to the measured value of the thickness of the wafer 1 in calculating the thickness of the wafer 1. Preferably, the thickness measurement point on the wafer 1 by the wafer height gauge 52, i.e., the contact point on the wafer 1 by the fluctuating probe 52*a* is set at an outer circumferential portion near the outer circumferential edge of the wafer 1.

Figure 4:
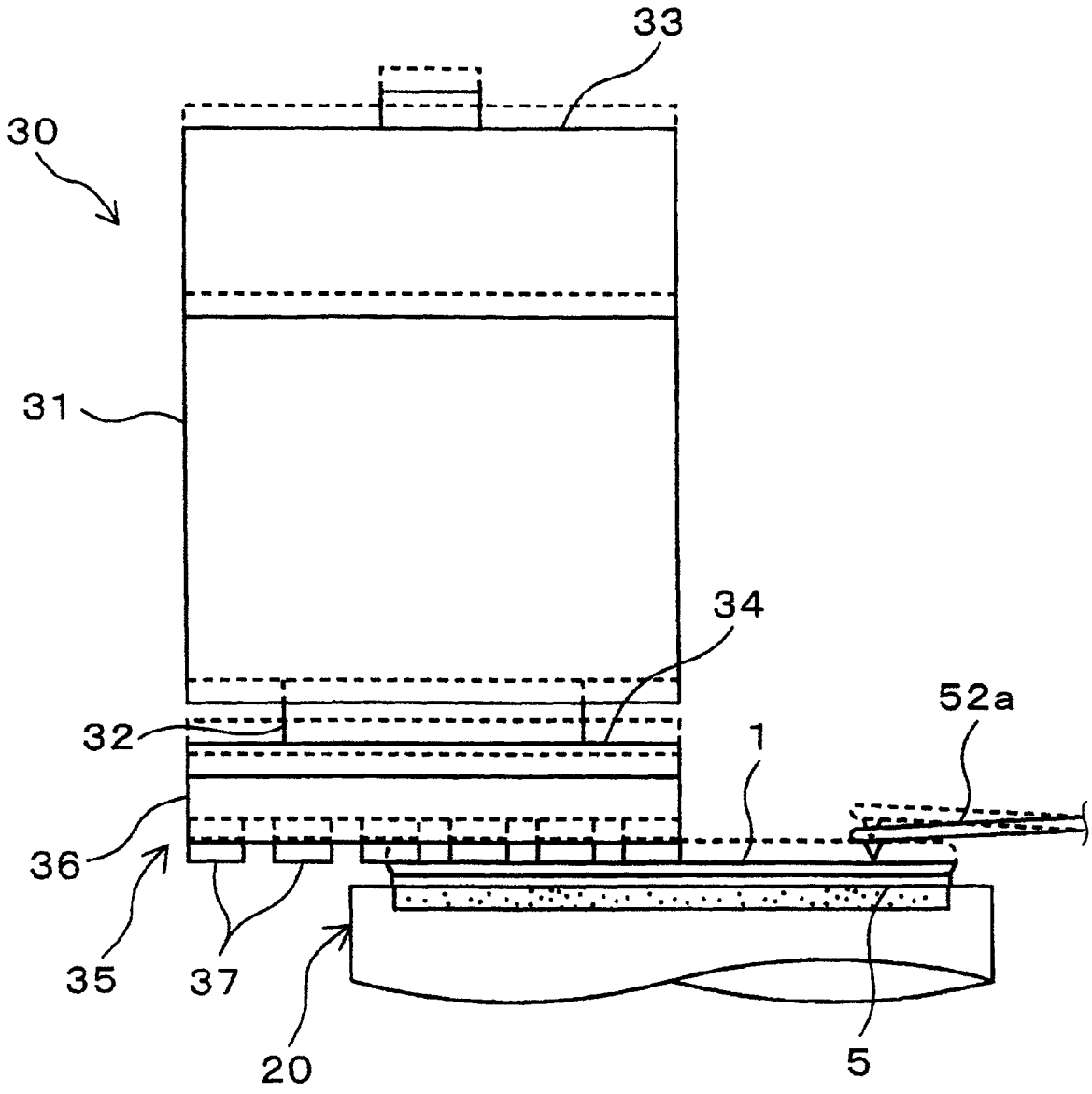
FIG. 4 is a side view showing a condition where the back side of the wafer has been ground by the grinding unit.

Each grinding unit 30 is fed in the Z direction at a predetermined speed (e.g., about 3 to 5 μm/sec for the primary grinding and about 0.2 to 0.5 μm/sec for the secondary grinding) as rotating the grinding wheel 35 at 3000 to 5000 rpm, so that the abrasive members 37 of the grinding wheel 35 come into pressure contact with the subject surface of the wafer 1 as the back side of the wafer 1 held on the chuck table 20, thus grinding the back side of the wafer 1. FIG. 4 shows a condition where the thickness of the wafer 1 has been reduced by this grinding operation of the grinding unit 30. During the grinding operation, the fluctuating probe 52*a* of the wafer height gauge 52 is always kept in contact with the upper surface of the wafer 1 to thereby sequentially measure the thickness of the wafer 1. Further, in the grinding operation, the wafer 1 is rotated by the rotation of the chuck table 20 in the same direction as the direction of rotation of the grinding wheel 35. The rotational speed of the wafer 1, or the chuck table 20 is usually set in the range of about 10 to 300 rpm. The grinding amount by each grinding unit 30 is controlled according to the measured value of the wafer thickness obtained by the thickness measuring gauge 50.

As shown in FIGS. 3A and 3B, the outer diameter of the ring formed by the abrasive members 37 of the grinding wheel 35 is set larger than the radius of the suction area 21 of each chuck table 20. Further, each chuck table 20 at the primary grinding position and the secondary grinding position is opposed to the corresponding grinding unit 30 so that the grinding saw as the lower end surface of each abrasive member 37 having a given width passes through the center of rotation of the chuck table 20, i.e., the center of the wafer 1. With this setting of the positional relation between each chuck table 20 and the corresponding grinding unit 30, the entire back side of the wafer 1 held on the chuck table 20 and rotated by the rotation of the chuck table 20 is uniformly ground by the abrasive members 37 of the grinding wheel 35.

In the grinding operation, the wafer 1 is first subjected to primary grinding by the grinding unit 30 at the primary grinding position. Thereafter, the wafer 1 is moved to the secondary grinding position by the rotation of the turn table 13 in the direction R shown in FIG. 2, and is subjected to secondary grinding by the other grinding unit 30 at the secondary grinding position. As shown in FIG. 3A, a saw mark 9 having such a pattern that many arcs radially extend from the center of the wafer 1 is left on the ground surface of the wafer 1 during the primary grinding. This saw mark 9 is removed by the secondary grinding, but a new saw mark is formed on the ground surface of the wafer 1 during the secondary grinding.

Having thus described the configuration of the grinding area 11A, there will now be described the configuration of the mount/demount area 11B. As shown in FIG. 2, a pickup robot 60 having a vertically movable two-joint link type swivel arm is located at the center of the mount/demount area 11B. Disposed around the pickup robot 60 are a supply cassette 61, positioning table 62, supply arm 63, cleaning nozzle 67, recovery arm 64, spinner type cleaning unit (cleaning means) 65, and recovery cassette 66, which are arranged in this order in the anticlockwise direction as viewed in plan. Each of the cassettes 61 and 66 is configured to store a plurality of wafers 1 in their horizontal condition so as to be stacked vertically at regular intervals. These cassettes 61 and 66 are set at predetermined positions on the base 11.

The wafer 1 to be ground is first taken out of the supply cassette 61 by the pickup robot 60, and is next placed on the positioning table 62, thus positioning the wafer 1. Thereafter, the wafer 1 is lifted from the positioning table 62 by the supply arm 63, and is next concentrically placed on the chuck table 20 waiting at the mount/demount position in such a manner that the back side of the wafer 1 is directed upward. Thereafter, the wafer 1 is moved to the primary grinding position and the secondary grinding position in this order by the rotation of the turn table 13 in the direction R. At these grinding positions, the back side of the wafer 1 is successively ground by the respective grinding units 30 as mentioned above.

The primary grinding and the secondary grinding are performed in the condition where the thickness of the wafer 1 is measured by each thickness measuring gauge 50, and the feed amount of each grinding wheel 35 by each feeding mechanism 43 is controlled according to the measured value obtained by each thickness measuring gauge 50. Thus, at the time of ending the secondary grinding, the thickness of the wafer 1 is reduced to a desired value. In the primary grinding, coarse grinding is performed until the thickness of the wafer 1 becomes larger than the desired value by 20 to 40 μm, for example, and in the secondary grinding, finish grinding is performed to remove the remaining thickness until the desired value is reached.

After ending the secondary grinding, the wafer 1 is returned to the mount/demount position by the rotation of the turn table 13 in the direction R. The wafer 1 on the chuck table 20 returned to the mount/demount position is lifted by the recovery arm 64 and is next moved to the cleaning unit 65 for cleaning the wafer 1. At the cleaning unit 65, the wafer 1 is held on a rotatable suction table similar to the chuck table 20, and a cleaning water such as pure water is sprayed to the ground surface of the wafer 1 to remove dust or the like caused by grinding. Thereafter, nitrogen gas or dry air is blown against the ground surface of the wafer 1 to dry it. The wafer 1 thus cleaned by the cleaning unit 65 is moved and stored into the recovery cassette 66 by the pickup robot 60. Further, the cleaning nozzle 67 functions to spray a cleaning water to the chuck table 20 located at the mount/demount position every time the wafer 1 is ground. Accordingly, before the wafer 1 is supplied from the supply arm 63 to the chuck table 20 located at the mount/demount position, this chuck table 20 is always kept clean.

[3] Control of Spark-Out

While the basic configuration of the grinding device 10 has been described, the spark-out of each grinding unit 30 for the primary grinding and the secondary grinding is controlled according to the maximum load current in the corresponding motor 33. A control method for the spark-out will now be described.

The spark-out is a processing operation such that when the thickness of the wafer 1 reaches a desired value during grinding, the feed of the grinding unit 30 is stopped and the rotation of the grinding wheel 35 is continued for a predetermined period of time at the feed stop position of the grinding unit 30 to thereby make flat the ground surface of the wafer 1. By performing the spark-out, various kinds of residual stress produced in the grinding device 10 during grinding are relieved, so that the abrasive members 37 come into engagement with the ground surface of the wafer 1, causing inertial grinding such that the wafer 1 is ground even after stoppage of the feed of the grinding unit 30. As described above, the amount of inertial grinding due to such residual stress changes with various factors during the repetition of grinding even under the same process conditions, resulting in variations in wafer thickness.

According to this preferred embodiment, the amount of inertial grinding on the wafer 1 in performing the spark-out is expected from the maximum load current in the motor 33 during the grinding of the wafer 1, and every time the grinding of the wafer 1 is finished, the spark-out start position is cyclically controlled to a position corresponding to the amount of inertial grinding. To realize this control, the correlation between the maximum load current in the motor 33 and the amount of inertial grinding after the grinding of the wafer 1 with the maximum load current is preliminarily grasped and a correction value corresponding thereto is preliminarily obtained. Table 1 shows an example of such a correction value. The correction value shown in Table 1 is the amount of upward adjustment from the feed stop position of the grinding unit 30 where the desired thickness of the wafer 1 is reached without inertial grinding. This upward adjustment amount is determined in expectation of the amount of inertial grinding, so that it is substantially equal to the amount of inertial grinding. The correlation between the correction value and the maximum load current is preliminarily stored in storing means 72 shown in FIG. 2.

TABLE 1

Correction Value corresponding to Maximum Load Current

| Maximum load current (A) | Correction value (μm) |
|---|---|
| 7.0 | 0 |
| 7.5 | 0.5 |
| 8.0 | 1.0 |
| 8.5 | 1.5 |
| . | . |
| . | . |
| . | . |

The spark-out start position of the grinding unit 30 is set at the time the wafer thickness measured by the thickness measuring gauge 50 has reached the sum of the desired value and the correction value (=the amount of inertial grinding) corresponding to the maximum load current. In the case that the correction value is zero shown in Table 1, a fixed correction value for the amount of inertial grinding is presupposed irrespective of the load current in the grinding device 10, and the spark-out start position reflects only such a presupposed correction value in this case. The reason for provision of the presupposed correction value is that the residual stress causing the inertial grinding does not become zero during grinding and that the presupposed correction value is therefore provided as a correction value for the amount of inertial grinding when the residual stress is at the lowest level. Accordingly, in the case that the correction value is not zero as shown in Table 1, the sum of the correction value shown in Table 1 and the above presupposed correction value is used as an actual correction value.

As shown in FIG. 2, the load current in the motor 33 of each grinding unit 30 is recognized by a load current monitor (motor load current monitoring means) 73. The maximum load current in the motor 33 in obtaining the correction value shown in Table 1 and the maximum load current in the motor 33 in actually grinding the wafer 1 are recognized by this monitor 73. The load current monitored by the load current monitor 73 is supplied to the feed control means 71. The wafer thickness measured by each thickness measuring gauge 50 is also sequentially supplied to the feed control means 71.

The feed control means 71 controls the back side grinding operation of each grinding unit 30 for the wafer 1 located at each grinding position in the following manner. First, the servo motor 42 is operated at a predetermined rotational speed to thereby rotate the feed mechanism 43, so that the grinding unit 30 is fed by the feed mechanism 43 in the condition where the grinding wheel 35 is rotated. Accordingly, the abrasive members 37 of the grinding wheel 35 come into pressure contact with the back side of the wafer 1, thereby grinding the back side of the wafer 1 to reduce the thickness of the wafer 1. Since the wafer 1 is rotated by the rotation of the chuck table 20, the whole back side of the wafer 1 is ground by the abrasive members 37.

Figure 5A:
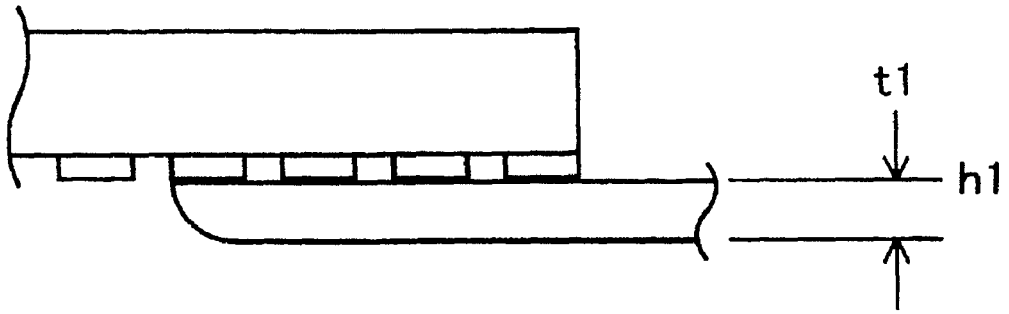
FIG. 5A is a side view showing a ground condition of the wafer after performing spark-out by the grinding unit in the case that the wafer is ground without inertial grinding to obtain a desired thickness.

The thickness of the wafer 1 is sequentially measured by the thickness measuring gauge 50, and when the feed control means 71 determines that the measured value of the wafer thickness has reached a desired value t1 as shown in FIG. 5A, the fluctuating probe 52*a* of the wafer height gauge 52 is separated from the wafer 1 and the servo motor 42 is simultaneously stopped to stop the feed of the grinding unit 30 at a stop position h1 as shown in FIG. 5A. At the stop position h1, the spark-out is started to continue the rotation of the grinding wheel 35 for a predetermined time period. After the elapse of the predetermined time period for the spark-out, the servo motor 42 is reversely operated to raise the grinding unit 30, thereby separating the abrasive members 37 from the wafer 1. This operation is a basic operation on the precondition that no inertial grinding occurs (actually, the amount of inertial grinding corresponding to the presupposed correction value mentioned above is produced), and the maximum load current monitored by the load current monitor 73 corresponds to the case where the correction value shown in Table 1 is zero.

Figure 5B:
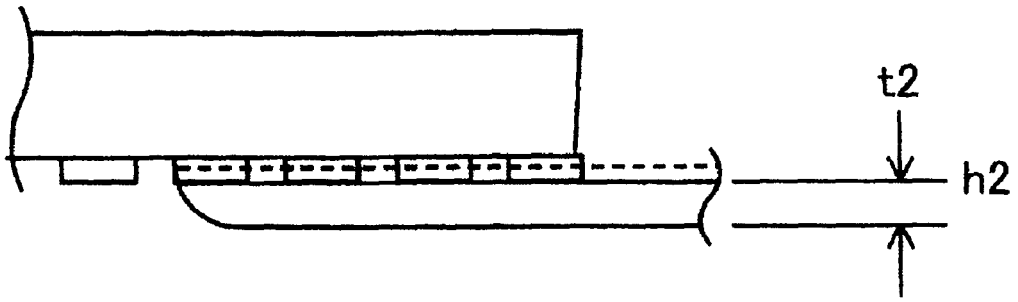
FIG. 5B is a view similar to FIG. 5A in the case that the spark-out is started when the wafer thickness has reached the desired thickness.

Numerous wafers 1 are ground by the grinding device 10, and various kinds of residual stress causing inertial grinding are involved in the grinding device 10 during the repetition of the grinding operations of the wafers 1. Accordingly, the inertial grinding due to the residual stress occurs in performing the spark-out. FIG. 5B shows a condition where the spark-out is started at the height h1 corresponding to the desired wafer thickness t1 and the inertial grinding proceeds down to a height h2 to cause a reduction in wafer thickness from t1 to t2 (which is smaller than t1). In this case, the difference (t1−t2) corresponds to the amount of inertial grinding (corresponding to the correction value mentioned above). The amount of inertial grinding gradually changes with the repetition of the grinding operations of the numerous wafers 1, causing variations in wafer thickness. Variations in the residual stress lead to variations in the maximum load current in the motor 33 (i.e., the maximum load current increases with an increase in the residual stress). It is therefore necessary to set the spark-out start position to a position higher than the height h1 corresponding to the desired wafer thickness t1 in expectation of the amount of inertial grinding.

Figure 5C:
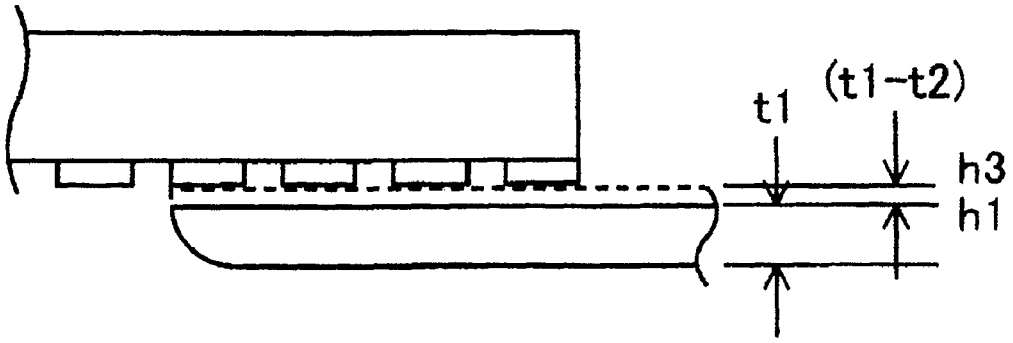
FIG. 5C is a view similar to FIG. 5A in the case that the wafer is ground with inertial grinding to obtain the desired thickness by adopting a control method according to the preferred embodiment.

According to this preferred embodiment, the feed control means 71 recognizes the maximum load current in the motor 33 during grinding and also recognizes the correction value corresponding to this maximum load current. In the case that the correction value is not zero, the feed control means 71 determines that the spark-out start position must be changed and accordingly changes the spark-out start position to a proper position. More specifically, it is determined that the wafer thickness measured by the thickness measuring gauge 50 has reached the sum of the desired value t1 and the correction value (t1−t2) corresponding to the maximum load current as shown in FIG. 5C, the fluctuating probe 52*a* of the wafer height gauge 52 is separated from the wafer 1 and at the same time the spark-out is started at a height h3. After the elapse of the predetermined time period for the spark-out, the servo motor 42 is reversely operated to raise the grinding unit 30, thereby separating the abrasive members 37 from the wafer 1.

Thus, the grinding unit 30 is stopped at the spark-out start position h3, and the spark-out is started at the position h3 to continue for the predetermined time period, during which the inertial grinding is allowed by the correction value corresponding to the maximum load current during the grinding operation, so that the wafer thickness after the spark-out becomes the desired value t1.

According to this preferred embodiment, the start position of the spark-out by the grinding unit 30 to be performed immediately after the end of the grinding operation for each wafer 2 is corrected to a position in expectation of the amount of inertial grinding corresponding to the maximum load current in the motor 33 of the grinding unit 30. Accordingly, the spark-out start position can be changed to a proper position every time the grinding operation for the wafer 1 is performed. As a result, the wafer thickness can be always reduced to a desired value with high accuracy, and variations in wafer thickness in grinding numerous wafers can also be suppressed.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding method for grinding a subject surface of a substrate by using a grinding device with grinding means opposed to a holding surface of holding means and having a rotation axis extending substantially parallel to a rotation axis of said holding means, comprising the steps of:

holding said substrate in said holding surface of said holding means in the condition where said subject surface of said substrate is exposed;

rotationally driving said grinding means with a motor;

monitoring a load current in said motor with a motor load current monitoring means;

relatively moving, by feeding means, said holding means and said grinding means in a direction of extension of said rotation axis of said grinding means toward and away from each other and for making said grinding means grind said subject surface of said substrate to reduce the thickness of said substrate by moving said grinding means toward said holding means;

measuring, by substrate thickness measuring means, the thickness of said substrate held by said holding means during grinding of said substrate by said grinding means;

performing spark-out, by feed control means, such that when the thickness of said substrate measured by said substrate thickness measuring means reaches a desired value, the feed of said grinding means by said feeding means is stopped and the rotation of said grinding means by said motor is continued for a predetermined period of time at the feed stop position of said grinding means;

preliminarily grasping the correlation between the amount of inertial grinding occurring in performing said spark-out by said grinding means and the load current in said motor monitored by said motor load current monitoring means; and starting said spark-out, by said feed control means, when the thickness of said substrate measured by said substrate thickness measuring means has reached the sum of said desired value and the amount of inertial grinding corresponding to the load current in said motor.

2. A grinding device comprising:

holding means having a holding surface for holding a substrate in the condition where a subject surface of said substrate is exposed;

grinding means opposed to said holding surface of said holding means and having a rotation axis extending substantially parallel to a rotation axis of said holding means;

a motor for rotationally driving said grinding means;

motor load current monitoring means for monitoring a load current in said motor;

feeding means for relatively moving said holding means and said grinding means in a direction of extension of said rotation axis of said grinding means toward and away from each other and for making said grinding means grind said subject surface of said substrate to reduce the thickness of said substrate by moving said grinding means toward said holding means;

substrate thickness measuring means for measuring the thickness of said substrate held by said holding means during grinding of said substrate by said grinding means;

feed control means for performing spark-out such that when the thickness of said substrate measured by said substrate thickness measuring means reaches a desired value, the feed of said grinding means by said feeding means is stopped and the rotation of said grinding means by said motor is continued for a predetermined period of time at the feed stop position of said grinding means; and storing means for storing the correlation between the amount of inertial grinding occurring in performing said spark-out by said grinding means and the load current in said motor monitored by said motor load current monitoring means;

wherein when the thickness of said substrate measured by said substrate thickness measuring means has reached the sum of said desired value and the amount of inertial grinding corresponding to the load current in said motor, said feed control means starts said spark-out.

* * * * *